United States Patent [19]

Heyden

[11] Patent Number: 4,795,270

[45] Date of Patent: Jan. 3, 1989

[54] RECLOSABLE BAG WITH A FOLDED PORTION ENGAGED BY A UNITARY MATERIAL SEPARATION ARRANGEMENT

[76] Inventor: Eugene L. Heyden, S. 627 Bernard, #8, Spokane, Wash. 99204

[21] Appl. No.: 10,189

[22] Filed: Feb. 2, 1987

[51] Int. Cl.[4] ..... B65D 33/16

[52] U.S. Cl. ..... 383/77; 383/10; 383/88

[58] Field of Search ..... 206/632, 610, 603; 383/88, 77, 72–76, 71, 61, 42, 7, 9, 10

[56] References Cited

U.S. PATENT DOCUMENTS

| | | | |
|---|---|---|---|
| 432,308 | 7/1890 | Guilbert | 383/88 |
| 1,236,285 | 8/1917 | Gallie | 383/77 |
| 2,189,174 | 2/1940 | Hohl . | |
| 2,260,064 | 10/1941 | Stokes . | |
| 2,329,360 | 9/1943 | Salfisberg . | |
| 2,643,049 | 6/1953 | Bartlet . | |
| 2,676,702 | 4/1954 | Whitefoot . | |
| 2,693,836 | 11/1954 | Hayes | 383/87 |
| 2,851,212 | 9/1958 | Parmer . | |
| 2,924,374 | 2/1960 | Vineberg | 383/88 X |
| 2,990,101 | 7/1961 | Mead et al. . | |
| 3,008,837 | 11/1961 | Kaplan | 383/10 X |
| 3,036,756 | 5/1962 | Lieschke . | |
| 3,083,821 | 4/1963 | Woodson . | |
| 3,187,983 | 6/1965 | Mandoza | 206/603 |
| 3,189,253 | 6/1965 | Mojonnier . | |
| 3,217,934 | 11/1965 | Schneider et al. | 383/88 X |
| 3,220,610 | 11/1965 | Specketer | 206/603 |
| 3,224,640 | 12/1965 | Schneider et al. | 383/88 X |
| 3,233,821 | 2/1966 | Ehlevs . | |
| 3,419,137 | 11/1967 | Wallcl, III . | |
| 3,456,867 | 7/1969 | Repko . | |
| 3,458,111 | 7/1969 | Leasure et al. . | |
| 3,618,850 | 11/1971 | Palmer . | |
| 3,730,421 | 5/1973 | Stanley | 206/603 |
| 3,785,111 | 1/1974 | Pike . | |
| 3,873,735 | 3/1975 | Chalin et al. | 206/806 |
| 3,891,775 | 6/1975 | Murray et al. | 383/10 X |
| 3,915,212 | 10/1975 | Bujan et al. | 383/10 X |
| 4,279,344 | 7/1981 | Holloway, Jr. | 206/631 |
| 4,445,230 | 4/1984 | Spadaro | 383/77 |
| 4,549,657 | 10/1985 | Martin | 383/77 |
| 4,603,537 | 8/1986 | Pace . | |
| 4,609,107 | 9/1986 | Martin et al. | 206/610 |

FOREIGN PATENT DOCUMENTS

| | | | |
|---|---|---|---|
| 2518929 | 11/1976 | Fed. Rep. of Germany | 206/603 |
| 2558802 | 8/1985 | France | 206/633 |

OTHER PUBLICATIONS

Product Instructions, La Suprema Tortilla Chips (date not available).

*Primary Examiner*—Stephen Marcus
*Assistant Examiner*—Bryon Gehman

[57] ABSTRACT

A bag construction adapted for reclosing. An elongated material separation arrangement of substantial width and transversely defined by an upper marginal region of the bag receives and positionally holds a folded over portion of the bag after an opening of same. A lower portion of a top seal is separated or removed to provide access to the contents of the bag. The upper marginal region of the bag may be fashioned in a variety of ways to convenience the opening of the bag.

16 Claims, 6 Drawing Sheets

Fig. 3.
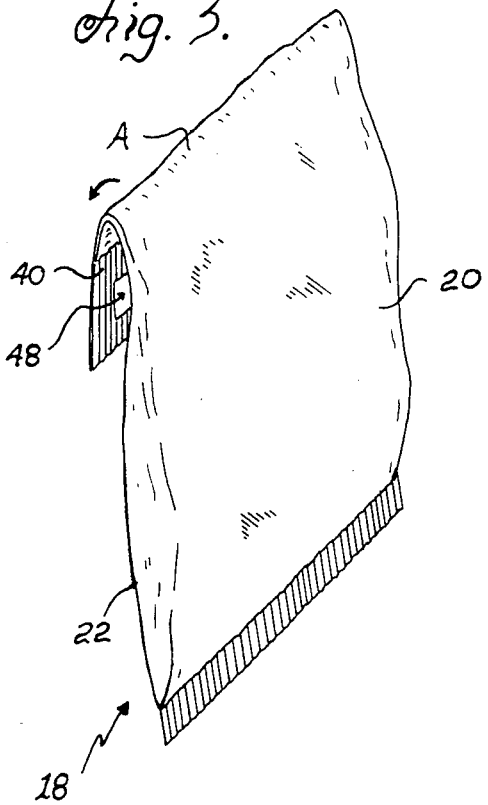
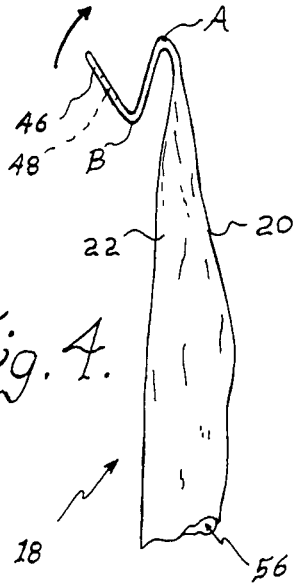
Fig. 4.
Fig. 5.
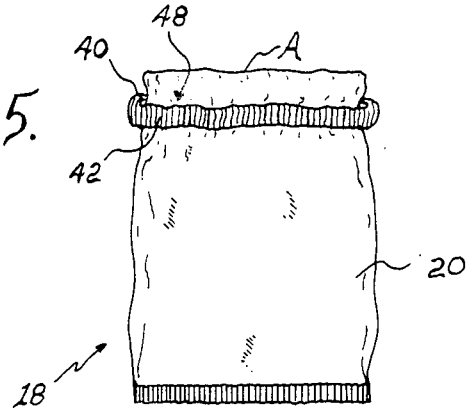

Fig. 9.
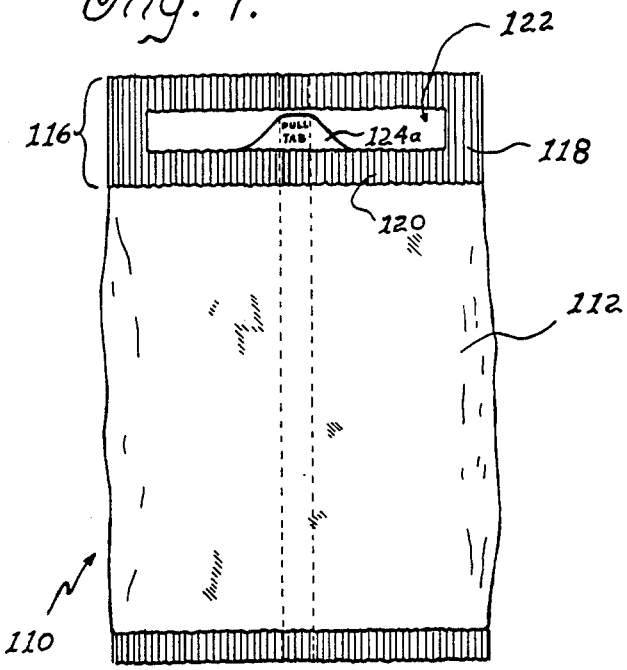
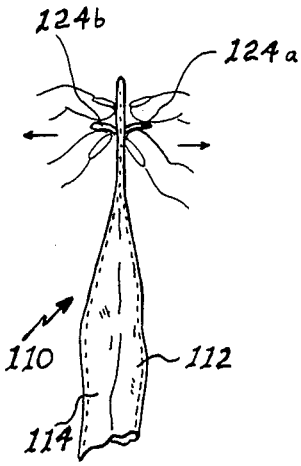
Fig. 10.
Fig. 11.
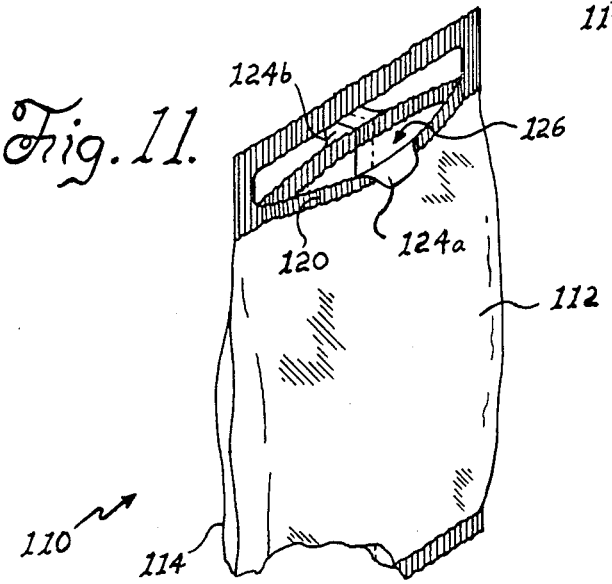

RECLOSABLE BAG WITH A FOLDED PORTION ENGAGED BY A UNITARY MATERIAL SEPARATION ARRANGEMENT

BACKGROUND OF THE INVENTION

This invention relates to package containers such as heat-sealable plastic or foil-type bags, and more particularly to alternative sealing and structural arrangements for such containers.

The common practice in the packaging of various commodities is to enclose same within plastic bags, such as those made of polyethelene and the like, having opposing front and rear panels and opposing transverse top and bottom seals. In bags of this class, the seals are conventionally formed by a combination of heat and pressure mechanically applied to appropriate locations on a continuously advancing web of sheet material previously formed into a generally tubular structure. In addition to top and bottom seals, a longitudinally extending, vertical midline seam is usually seen on a rear panel of the bag and is formed by heat-sealing overlapping edges of the sheet material used in its construction. The top and bottom seals, which are often three-eighths to three-quarters of an inch in width, may take on a corrugated or pleated appearance, while the midline seam is generally flat in character and may be folded against the rear panel of the bag.

Packaged food items, such as snack foods and frozen foods, represent a type of commodity which may not be entirely used after opening. It is often desireable to store such contents in the package until the package is empty. Particularly with regard to food items, it is desirable, after opening, to reclose the bag in some fashion which will return the bag to a substantially closed state, in an effort to preserve the freshness of the product and to prevent a spilling of contents. Examples of reclosing arrangements are Lieschke, U.S. Pat. No. 3,036,756; Ehlers, U.S. Pat. No. 3,233,821; Palmer, U.S. Pat. No. 3,618,850; and Pace, U.S. Pat. No. 4,603,537. As prior art teaching has been found difficult or expensive to practice, or otherwise unacceptable, often no provision attends the construction of the bag which allows for an effective bag reclosing.

Because of the inherent strengh of the heat seals, packaging material, and/or structural formation of the bag itself, another problem related to the construction of plastic bags is a difficulty encountered in their opening. This problem is well known, and has been addressed in the past by the use of readily openable heat seals (U.S. Pat. No. 4,603,537 to Pace), tear strips (U.S. Pat. No. 2,613,049 to Bartelt), perforated lines (U.S. Pat. No. 3,189,253 to Mojonnier), and tab projections in various forms (U.S. Pat. No. 2,189,174 to Hohl and U.S. Pat. No. 3,036,756 to Lieschke), to mention a few of the easy-opening provisions for plastic bags and the like. Because of inherent drawbacks in practicing some of these and other prior art methods and arrangements, often no special provision is made in the construction and sealing of bags to convenience their opening. Therefore, the consumer is left to the undesireable or difficult task of tearing at the bag or cutting the bag to gain access to its contents.

The present invention provides an improved bag construction which fulfills a much-needed resealing function and which, in turn, readily lends itself to the practice of embodiment which allow for an ease-of-opening for access to package contents.

It is, therefore, a principle object of the present invention to provide an improved bag construction which allows for an effective reclosing of the bag after opening.

It is another object of the present invention to provide a reclosing arrangement for bags, together with further improvements in bag construction favoring a convenient and easy opening thereof.

These and other objects will become apparent from a study of the summary and the detailed description of the invention in light of the attending drawing.

SUMMARY OF THE INVENTION

In an embodiment which best illustrates the principles of the invention, a bag of flexible material and largely of recognizably conventional construction is adapted for reclosing, and for this purpose contemplates the use of a transversely extending separation of packaging material of substantial width arranged and adapted to receive and positionally hold a folded-over portion of the bag. The material separation arrangement which extends in length a substantial distance across the width of the bag and involves both its front and rear panels, is placed a distance from the top margin of the bag, and is defined within an upper marginal region and between surrounding portions of a top seal. A lower portion of the top seal, which contributively defines both the upper marginal region and a commodity-confining compartment is intentionally separable for access to contents contained therein. A bottom seal, which also contributively defines said compartment, intimately relates with the bottom margin of the bag. The reclosing of the bag comprises steps performed following a separation of the lower portion of the top seal, and includes a transverse folding of the bag at a location suitably below the material separation and an introduction of said folded portion a distance within said material separation arrangement.

BRIEF DESCRIPTION OF THE DRAWING

The invention can best be understood in conjunction with the accompanying drawing in which:

FIGS. 3 through 5 illustrate the steps performed in reclosing the bag in each of its several embodiments;

FIGS. 9 through 11 represent the invention in yet another embodiment.

DETAILED DESCRIPTION

Figure 1:
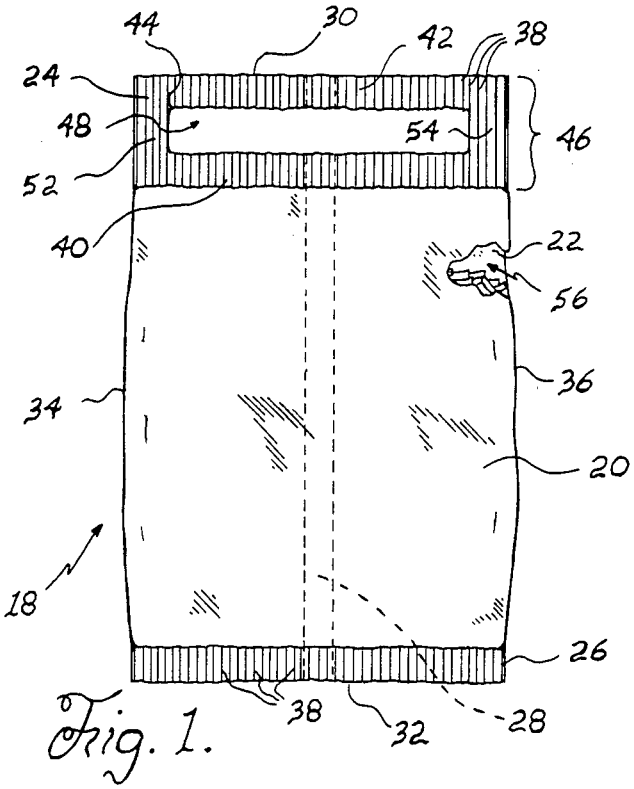
FIG. 1 is a front elevation of a bag construction representing the invention in the preferred embodiment, having a portion thereof partially broken away to reveal the commodity-confining compartment and a rear panel of the bag.
Figure 2:
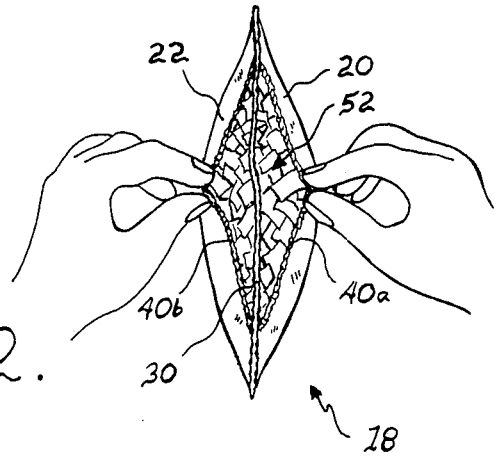
FIG. 2 is a top view of the bag of FIG. 1 opened.

Referring now in greater detail to the drawing, and with particular reference to FIGS. 1 and 2, the bag, referred to generally by reference numeral 18, comprises a package defined by a front panel 20 and an opposing rear panel 22, an elongated top seal 24 associated with a top margin 30, an opposing bottom seal 26 associated with a bottom margin 32, and opposing side margins 34 and 36. A midline seam 28, situated on the rear panel of the bag, is formed by heat sealing overlapping edges of packaging material, and represents the conventional practice of forming a generally tubular structure from an advancing web of flexible packaging material. The bag 18 is thin-walled and flexible in nature and may be constructed of polyethylene, polypropylene, or other heat-sealable materials or material laminations customarily used in the packaging industry, not to exclude future improvements on existing materials or materials heretofore unknown. In keeping with the resealing function of the bag, a preferred material would be one that particularly resists tearing under usual stresses.

The top seal 24 and the bottom seal 26 of the bag contributively define a commodity-confining compartment 56 and initially close the package when formed, and represent heat seals of satisfactory width and character performed to sealingly approximate portions of opposing panels of packing material per conventional practice. Also per conventional practice, the top and bottom seals are corrugated in nature, having vertical heat-sealing lines 38, while the midline seam 28 is generally flat in character, though of similar width.

It has been found that heat seals of the corrugated or pleated type in polyethylene and polypropylene, for example, can be intentionally made to be separable if formed in a temperature range of 177 to 250 degrees Celsius. (See U.S. Pat. No. 4,603,537 to Pace.) A separable seal characteristic is contemplated in the practice of the preferred embodiment and other embodiments of the invention. Accordingly, FIG. 2 illustrates the opening of the bag 18 by first pinching a portion of the bag on both front and rear panels a suitable distance below the top seal 24 and then pulling apart a lower portion 40 of the top seal.

Particularly evident from a study of FIG. 1, the top seal 24 of the bag, though similar in nature to the bottom seal 26, is of a substantially greater width than the bottom seal and defines an upper marginal region 46 that includes a transversly extending nad elongated material separation 48 of generally rectangular shape extending a substantial distance across this upper portion of the bag. The material separation 48, which may be stamped or punched out of the packaging material at the appropriate location on the bag, may be performed during the sealing of the bag by use of sealing shoes adapted to punch through and remove a necessary amount of packaging material while at the same time sealing the bag. This through-the-bag separation comprises an intentional absence of packaging material in ts upper marginal region 46 which serves as a generally rectangular receptive area for receiving a folded over portion of the bag, and involves approximated portions of its front and rear panels 20 and 22. Further, the material separation 48 divides the top seal (and also the upper marginal region 46) into evident portions: an upper portion 42 relating particularly to the top margin 30 of the bag, a lower portion 40 relating particularly to the commodity-confining compartment 56, and side portions 52 and 54 communicating respectively with side margins 34 and 36.

Also evident from a study of FIG. 1 is the curved nature of the four corners of packaging material the material separation 48, reference numeral 44 designating an example. It has been found that corners which define sharp angles packaging material separations create tear-initiating zones at points of angular intersection, whereas corners of a curved nature modify stresses and resist the initiation of tearing thereat. The provision of curved corners in the definition of the material separation has been found helpful in preventing an unintentional tearing occurrence from within the upper marginal region of the bag.

As previously mentioned, the lower portion 40 of the top seal provides access to the contents of the package and is separable to a necessary width, or to the full width of the bag, when associated portions of the bag panels are pulled apart. The opening of the bag, in this manner, is illustrated in FIG. 2 and occurs when the opposing panels of the bag are grasped at a location below and near the lower portion 40 of the top seal and are subsequently pulled apart. It will be seen that the opening of the bag in this manner does not result, under normal circumstances, in a tearing away of the upper portion 42 of side portions 52 and 54 of the top seal. It will also be seen that the upper portion 42 of the top seal does not interfere with access to package contents. Additionally, the lower portion 40 of the top seal may be opened the full width of the bag without tearing the upper portion or the side portions of the top seal away from the bag. As shown in the figure, upon separating the lower portion of the top seal, a bag mouth 52 appears and is margined by opposing lip portions **40*a* and 40*b* evident following the separation of the lower portion 40** of the top seal.

It should be pointed out that the top seal 24, as well as the material separation 48, may be formed alternatively than described above or as depicted in the drawing without a departure from the principles of the invention. For example, the upper portion of the bag may be sealed only at a location below the material separation; however, a sealing of the upper marginal region, as shown, is preferred and will strengthen this portion of the bag and serve to reduce a potential tearing and unintended loss of this upper portion of the bag, particularly in the region of the side portions 52 and 54. Furthermore, the bag may be folded as shown in FIG. 5, or at another suitable location in the vicinity of the material separation, prior to consumer acquisition. Such a pre-folding would discourage an unintended use of the material separation for hanging the package or the use of the upper portion 42 of the top seal as a handle, activities which may tear loose the upper portion of the top seal from the bag and prevent the use of its resealing function.

FIGS. 3, 4, and 5 demonstrate the reclosing sequence contemplated for package reclosure according to the present invention and the purpose and function of the elongated material separation. The reclosing sequence is manually performed according to the steps illustrated in FIGS. 3 and 4 to accomplish an end result, as illustrated in FIG. 5.

With regard to the reclosing sequence, FIG. 3 illustrates a first fold A performed across the commodity-confining compartment of the bag 18 below, and in the vicinity of, the lower portion 40 of the top seal. Accordingly, the bag is folded backward in direction and away from its front panel 20 (indicated by the arrow), an action which places the material separation 48 closely adjacent a portion of the rear panel 22 of the bag. A second fold B, illustrated in FIG. 4 and occurring between fold A and the material separation, is then performed to bring the upper marginal region 46 away from the rear panel 22 of the bag and toward its front panel 20 in an arcuate manner. (A reverse of this process, i.e. folding forward and then backward to accomplish folds A and B respectively, comprises an equivalent operation.) Continuing, the steps illustrated in FIGS. 3 and 4 create folds (i.e. folds A and B) in the bag which effect a closure of the commodity-confining compartment 56, and also position the material separation 48 for a placement of the folded-over portion of the bag associated with fold A to within the elongated material separation 48 and between the upper portion 42 and the lower portion 40 of the top seal, as illustrated in FIG. 5.

It should be pointed out that, when reclosing the bag, it is intended that the edges or margins of the bag in the area of the folded-over portion be deformed inwardly sufficient to be readily accepted by and within the material separation. It should also be pointed out that the material separation is represented in the various figures of the drawing as being sufficiently elongated and sized to satisfactorily and readily accomodate the folded-over portion of the bag. It has been found quite satisfactory, for example, in a bag measuring approximately 24 cm across, to offset a material separation 1.5 cm to 3 cm from each side margin of the bag. Equally satisfactory is a material separation 1.5 cm to 3 cm in width.

Having thus described the invention in its preferred embodiment, attention will now be directed to alternatives in bag construction stemming therefrom which represent further expressions of inventive effort.

Figure 6:
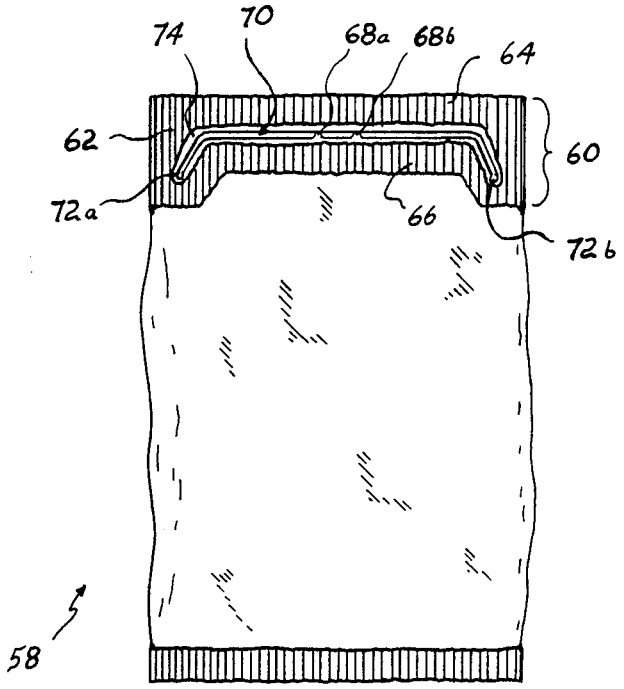
FIG. 6 demonstrates the invention in an alternative embodiment.

In FIG. 6, the bag 58 illustrated is constructed similarly to that which appears in FIGS. 1 through 5, with the exception of detail within its upper marginal region 60, and contemplates a separable lower portion 66 of a top seal 62. Specifically, a multiple material separation arrangement 70 divides the top seal 62 into an evident upper portion 64 and an evident lower portion 66, and comprises an arrangement of thin, aligned separations in and through the bag that collectively extend a substantial distance across the width of the bag, angulate downward, and then terminate at opposing side locations. The multiple material separation arrangement 70 is interrupted in its progression across the bag by brief marginal interconnections **68*a* and 68*b*. The marginal interconnections 68*a* and 68*b***, though optional in the practice of the invention, serve to maintain the general shape of the bag until opened, and help prevent an unintended separation or loss of the upper part of the upper marginal region away from its lower part by offering a degree of structural stability to the upper marginal region of the bag.

Additional features which improve the quality of this embodiment are a circular character of the material separation terminations **72*a* and 72*b* and a thin unsealed border 74 intimately surrounding the entire multiple material separation arrangement 70. The purpose of the circular presentation of terminations 72*a* and 72*b* is to help prevent a tear initiation thereat with a possible loss of the resealing function of the bag, analogous to the curved corners bordering the material separation, exemplified by reference numeral 44 in FIG. 1. The purpose of the unsealed border 74 is similar to the purpose of the circular nature of terminations 72*a* and 72*b*—namely, to deter a tear initiation at any location on the bag closely or intimately related to the multiple material separation arrangement 70**. It accomplishes this purpose by allowing a degree of stretch and modification of stresses to occur thereat when the material of the bag is stressed.

The lower portion 66 of the top seal 62, in this construction, is seen to follow or pattern the configuration of the multiple material separation arrangement 70 in its progression across the bag. This, too, is an optional feature, as this portion of the top seal may be constructed to extend straight across the bag. However, by deviating upward from its sides, as shown in the figure, a general uniformity in the width of this portion of the top seal is maintained as it extends across the bag, preventing an increase in difficulty encountered when opening the bag, such as would occur should be lower portion of the top seal be substantially widened by extending straight across.

The bag 58 is opened according to the operation represented by FIG. 2, and is reclosed by the steps illustrated in FIGS. 3 through 5. It will be seen that the marginal interconnections **68*a* and 68*b*, which are small and therefore somewhat weak in nature, will break during the stress of opening the bag and will subsequently allow a folded-over portion of the bag to enter the multiple material separation arrangement during reclosing. Optionally, the marginal interconnections may be first broken by lifting the upper portion 64 of the top seal a short distance away from the lower portion 66** of same before an opening of the bag is performed.

It should be pointed out the multiple material separation arrangement 70 comprises a thin material loss extending across the upper marginal region 60 of the bag. Alternatively, the multiple material separation arrangement (or a material separation arrangement of a singular nature, as in FIGS. 1–5) could comprise a similarly arranged cut or slit through the bag, representing no material loss or material removal whatsoever, and its practice would be an attractive form of this particular embodiment of the invention from the standpoint of ease of accomplishment, since an amount of the packaging material need not be removed and disposed of.

Figure 7:
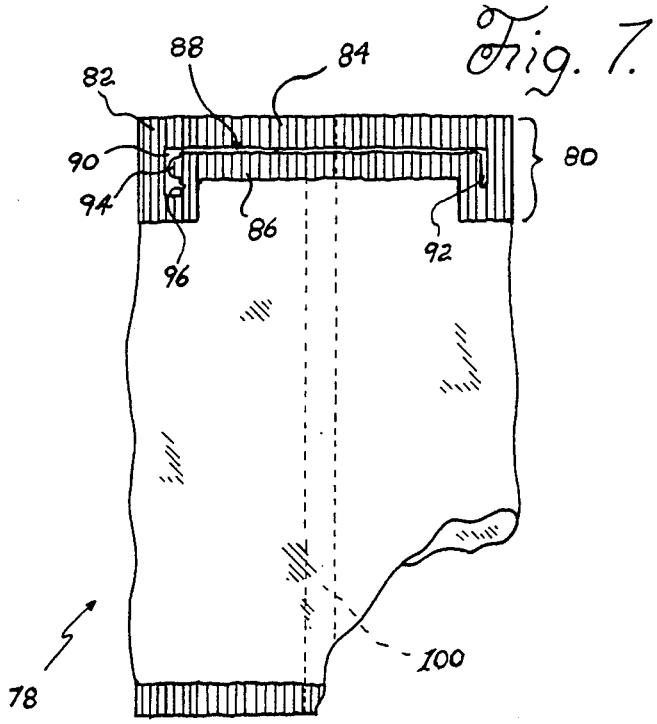
FIGS. 7 and 8 represent the invention in another alternative embodiment.
Figure 8:
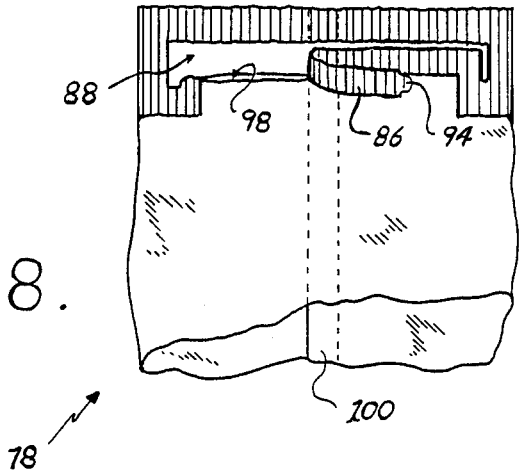

FIGS. 7 and 8 represent an embodiment of the invention having features in similarity with both conventional practice and other embodiments of the present invention but which does not require a pulling apart of the opposing panels of the bag to effect its opening. Instead, a controlled tearing of a portion of the bag provides access to its contents, and also enlarges the width of the material separation at the same time.

The bag, represented by reference numeral 78, contemplates an upper marginal region 80 which includes a thin, elongated material separation 88 which extends across the width of the bag and then extends downwardly a predetermined distance to define side areas 90 and 92 spaced a suitable distance from the side margins of the bag. The material separation 88 divides the top seal 82 into evident upper and lower portions, 84 and 86 respectively. It is seen that the side areas 90 and 92 are completely bordered by the top seal 82 and extend downwardly a short distance below the lower portion 86 of said top seal. The top seal 82, or upper portion 84 thereof, may be understood and viewed as extending across the top of the bag, down its sides or margins a short distance, around side portions 90 and 92, and then upwardly until it merges with the lower portion 86 of the top seal.

The opening of the bag 78, which is represented in FIG. 8, is accomplished by the provision of a side tab 94 lateral the lower portion 86 of the top seal and a tear-initiating notch 96 defined at the base of the side tab 94, both of which are defined by material loss at side area 90. To open the bag, then, a thumb and forefinger grasp of side tab 90 is performed while the bag is held near the tear-initiating notch by the thumb and forefinger of the opposing hand. The tab is then pulled laterally away from the bag in an action that initiates a tearing at notch 96 and a tearing continuation across the bag below the lower portion 86 of the top seal until this lower portion of the top seal is removed. A bag mouth 98 becomes evident by the tearing and removal of the lower portion of the top seal in the manner described.

The reclosing of the bag 78 is accomplished by the sequence illustrated in FIGS. 3, 4, and 5.

A special consideration in the practice of this form of bag construction is a midline seam 100 formed to allow a tearing to be completed, in an uninterrupted manner, through and past the seam. This may be suitably accomplished by involving both overlapping edges in the formation of the seam and by forming the seam with heat and pressure sufficient to create a separation-resistant bond between the overlapping edges of the packaging material. In this way, the tear which initiates the opening of the bag can progress across the bag without interruption or entanglement with a separating or otherwise uncooperating midline seam.

In FIGS. 9 through 11, an alternate form of the invention is shown which incorporates the use of opposing pull tabs to aid in the opening of the bag. A first pull tab **124*a* is in direct view in FIG. 9 and is opposed, in back-to-back relation, by a second pull tab 124*b* which appears in direct view in FIGS. 10 and 11. The pull tabs 124*a* and 124*b* present as closely approximated projections of both front 112 and rear panels 114 of the bag 110, and emerge, relatively speaking, within an elongated material separation 122 that is defined within an upper marginal region 116 of the bag. The tabs are not sealed together as is the remainder of the packaging material within the marginal region, and are therefore freely separable. A top seal 118 with a separable lower portion 120** is contemplated in this form of bag construction.

To open the bag, a thumb and forefinger grasp of each tab, as in FIG. 10, will allow for a separation of the lower portion 120 of the top seal to occur when the tabs are pulled away from each other. A bag mouth 126 becomes evident and provides access to the contents of the bag, as illustrated in FIG. 11.

The reclosing of the bag is performed by the steps illustrated in FIGS. 3 through 5.

A consideration of the practice of this form of bag construction is the inclusion of one or a plurality of brief marginal interconnections (not shown) between the tabs and the upper portion of the top seal, similar or identical to those described in connection with FIG. 6 and provided for the same purpose.

Figure 12:
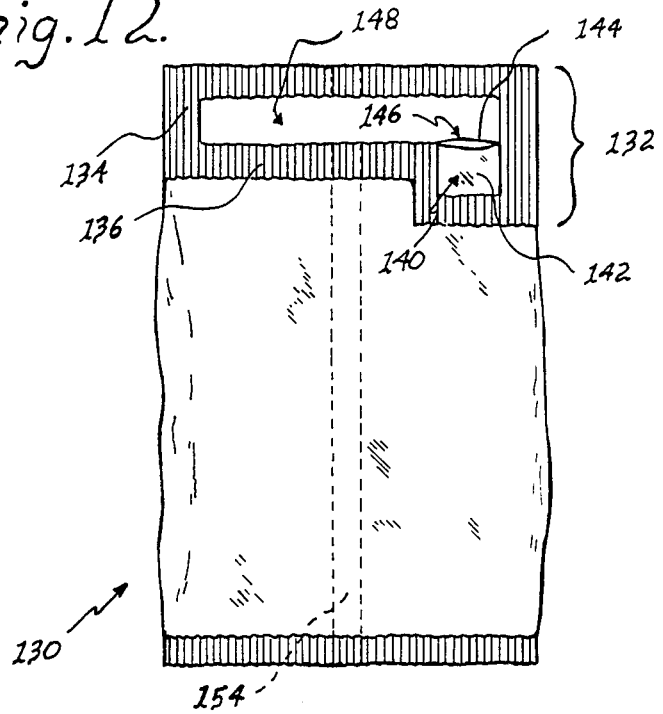
FIGS. 12 and 13 represent an additional alternative in bag construction equally within the spirit and scope of the present invention.
Figure 13:
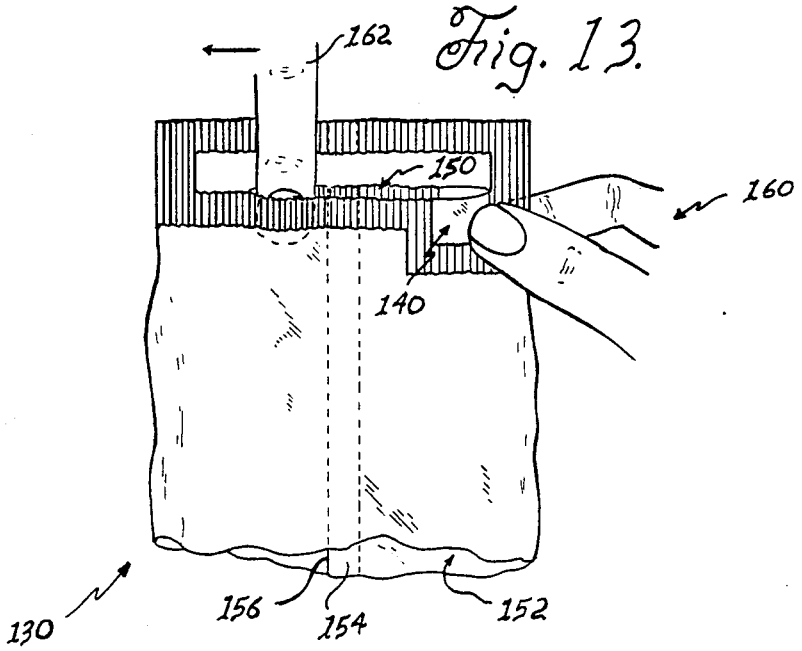

In FIGS. 12 and 13 another alternative in bag construction is presented. The bag 130 is constructed substantially identical to the bag construction which appears in FIGS. 1–5, with the exception of an upper marginal region of alternate construction. The upper marginal region 132 defines a recessively defined pocket 140 which is bordered by an evident lower portion 136 of a top seal 134, by opposing and unsealed pocket walls 142 and 144, and by an elongated material separation 148 formed within the upper marginal region of the bag. The pocket 140, which is bordered on three sides by the top seal 134, defines an unsealed area within the upper marginal region which extends from the material separation 148 to below the major part of the lower portion 136 of the top seal in an arrangement whereby a portion of the pocket resides at the side of, or laterial to, an upper portion of the commodity-confining compartment 152, a provision which will become apparent in the discussion of the opening of the bag. Also, an open pocket mouth 146 is seen that allows the admission of a blunt object, such as a forefinger, to initiate the opening of the bag, as will presently be discussed.

The opening of the bag is depicted in FIG. 13. To accomplish this task, the bag may be grasped with the thumb and forefinger 160 of one hand at a suitable location near the pocket and associating side margin of the bag, and the forefinger 162 of the other hand is inserted deep within the pocket 140. Because the pocket extends below a major part of the lower portion 136 of the top seal and at the side of the commodity-confining compartment, the tip of the forefinger will enter the commodity-confining compartment 152 when the forefinger is moved in a direction away from the pocket 140 and toward the other side of the bag. The performance of such a step separates the lower portion 136 of the top seal and effects a bag mouth 150 for access to package contents.

The reclosing of the bag is accomplished according to the steps outlined in FIGS. 3 through 5.

A special consideraton in the practice of this form of bag construction is the location of the pocket 140 with respect to the overlapping arrangement of a midline seal 154. To prevent a possible exit of the forefinger out the midline seam at it meets and attempts to pass said seam, it is desireable to overlap the edges of packaging material in such a way that the edge 156 furthest the pocket is defined within the commodity confining compartment 152, as illustrated in FIG. 13. Alternatively, the midline seam may be of a strongly-bonded type which resists separation, and can then be constructed without respect to the placement of the pocket.

In closing, it should be noted that the exclusive use of the corrugated-type heat seal in FIGS. 1 through 13 does not limit the invention solely thereto, as it would be in keeping with the spirit and scope of the present invention to use other types of seals such as thin, non-corrugated heat seals or seals accomplished by means other than heat sealing.

What is claimed is:

1. A package of flexible packaging material comprising opposing front and rear panels, opposing side margins, opposing top and bottom margins, and a commodity-confining compartment formed by said panels and situated between the top, bottom, and side margins of said package, said package further comprising:

an upper marginal region defined across the width of said package and located between said commodity-confining compartment and said top margin;

a material separation arrangement defined by the packaging material within said upper marginal region, said material separation arrangement arranged and defined across a substantial amount of the width of said upper marginal region;

a first closure field effected across said commodity-confining compartment a substantial distance below said material separation arrangement;

a second closure fold effected across said package between said top and bottom margins, said second closure fold residing between said first closure fold and said material separation arrangement; and a folded portion of said package located in the vicinity of said first closure fold and received within said material separation arrangement.

2. The package as defined in claim 1, wherein said package defines a transverse seal means substantially surrounding said material separation arrangement, said transverse seal means defined by said package for sealing together portions of said panels in order to effect a top seal across the width of said package; and said folded portion is substantially surrounded by said top seal.

3. The package as defined in claim 2, wherein said material separation arrangement is substantially surrounded by an unsealed border means comprising unsealed portions of said panels located between said top seal and said material separation arrangement.

4. The package as defined by claim 2, wherein said package includes a bottom seal located in the vicinity of said bottom margin.

5. The package as defined by claim 4, wherein said packaging material is a heat-sealable material, and said top and bottom seals comprise heat seals.

6. The package as defined by claim 5, wherein said heat seals are formed to include repetitive heat-sealing lines.

7. The package as defined in claim 1, wherein said material separation arrangement is of generally rectangular configuration.

8. The package as defined by claim 7, wherein said material separation arrangement is generally curved at corner locations defined by the packaging material within said upper marginal region in order to prevent the initiation of tearing of the material within said upper marginal region.

9. A method of reclosing an elongated package including opposing panels and an elongated material separation arrangement effected across a substantial amount of the width of said package, and wherein said material separation arrangement resides in the vicinity of a top margin and between said top margin and a commodity-confining compartment, said method comprising the steps of:

effecting a first closure fold across the width of said commodity-confining compartment at a location a substantial distance below said material separation arrangement by folding over portions of said panels;

effecting a second closure fold across the width of said package between said first closure fold and said material separation arrangement; and inserting said first closure fold within said material separation arrangement.

10. In combination:

a package of flexible packaging material including opposing panels, opposing top and bottom margins, opposing side margins and a commodity-confining compartment formed by said panels and situated between said top, bottom and side margins of said package;

a transverse seal means sealingly joining said panel members and located between said top margin and said commodity-confining compartment, said transverse seal means extending across the width of said package whereby an upper marginal region is defined between said top margin and said commodity confining compartment and extends across the width of said package above said commodity-confining compartment; and a material separation arrangement defining a substantially rectangular absence of packaging material in each said opposing panel within said upper marginal region, said material separation arrangement extending substantially the width of said package, but leaving a transverse seal means portion on each side of said material separation arrangement between said side margins and said material separation arrangement, said material separation arrangement being separated from said commodity-confining compartment means by at least a portion of said transverse seal means;

whereby said material separation arrangement is provided and adpated to receive and retain a folded-over portion of said package which has been folded across said commodity-confining compartment in order to effect package reclosure after an opening of said package occurring in the vicinity of said material separation arrangement.

11. The package as defined in claim 10, wherein said transverse seal means defines a top seal substantially surrounding said material separation arrangement, said top seal extending across the width of said package.

12. The package as defined by claim 11, wherein said package includes a bottom seal substantially opposing said top seal and located in the vicinity of said bottom margin.

13. The package as defined by claim 12, wherein said packaging material is a heat-sealable material, and said top and bottom seals comprise heat seals.

14. The package as defined by claim 13, wherein said heat seals are formed to include repetitive heat-sealing lines.

15. The package as defined by claim 10, wherein said material separation arrangement is generally curved at corner locations in order to prevent the initiation of tearing of the material within said upper marginal region.

16. The package as defined in claim 10, wherein said material separation arrangement is substantially surrounded by an unsealed border means comprising unsealed portions of said panels located between said top seal and said material separation arrangement.

* * * * *

UNITED STATES PATENT AND TRADEMARK OFFICE

CERTIFICATE OF CORRECTION

PATENT NO. : 4,795,270

DATED : Jan. 3, 1989

INVENTOR(S) : Eugene L. Heyden

It is certified that error appears in the above-identified patent and that said Letters Patent is hereby corrected as shown below:

Col. 2, line 23, a comma should appear after "arrangement".
line 31, a comma should appear after "compartment".
Col. 3, line 43, "nad" should be --and--.
line 53, "ts" should be --its--.
line 66, after "material" insert --defining--.
Col. 4, line 1, after "angles" insert --bordering--.
Col. 6, line 28, after "out" insert --that--.

Signed and Sealed this

Twenty-fourth Day of October, 1989

*Attest:*

DONALD J. QUIGG

*Attesting Officer*

*Commissioner of Patents and Trademarks*